US008546055B2

(12) United States Patent
Nakayama et al.

(10) Patent No.: US 8,546,055 B2
(45) **Date of Patent: *Oct. 1, 2013**

(54) TONER AND DEVELOPER

(75) Inventors: Shinya Nakayama, Shizuoka (JP); Hisashi Nakajima, Shizuoka (JP); Saori Yamada, Shizuoka (JP); Mitsuo Aoki, Shizuoka (JP); Hyo Shu, Shizuoka (JP); Hiroyuki Kishida, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 220 days.

This patent is subject to a terminal disclaimer.

(21) Appl. No.: 13/063,701

(22) PCT Filed: Sep. 2, 2009

(86) PCT No.: PCT/JP2009/065619

§ 371 (c)(1),
(2), (4) Date: Mar. 11, 2011

(87) PCT Pub. No.: WO2010/029903

PCT Pub. Date: Mar. 18, 2010

(65) Prior Publication Data

US 2011/0165508 A1 Jul. 7, 2011

(30) Foreign Application Priority Data

Sep. 12, 2008 (JP) ..... 2008-234345

(51) Int. Cl.
*G03G 9/087* (2006.01)

(52) U.S. Cl.
USPC ..... 430/109.4

(58) Field of Classification Search
USPC ..... 430/109.4
See application file for complete search history.

(56) References Cited

U.S. PATENT DOCUMENTS

| | | | | |
|---|---|---|---|---|
| 3,985,665 | A * | 10/1976 | Sakaguchi et al. | 430/109.4 |
| 4,863,824 | A * | 9/1989 | Uchida et al. | 430/109.4 |
| 7,232,636 | B2 * | 6/2007 | Semura et al. | 430/109.4 |
| 7,521,164 | B2 | 4/2009 | Nakayama et al. | |
| 7,713,672 | B2 * | 5/2010 | Watanabe et al. | 430/123.5 |
| 8,114,560 | B2 * | 2/2012 | Nakayama et al. | 430/109.4 |
| 8,236,470 | B2 * | 8/2012 | Ueno et al. | 430/109.4 |
| 2007/0281235 | A1 | 12/2007 | Ono et al. | |
| 2008/0118855 | A1 * | 5/2008 | Nakayama et al. | 430/109.4 |
| 2008/0280218 | A1 | 11/2008 | Sabu et al. | |
| 2008/0280219 | A1 | 11/2008 | Nakayama et al. | |
| 2008/0318143 | A1 * | 12/2008 | Nakayama et al. | 430/48 |
| 2009/0103950 | A1 | 4/2009 | Nakayama et al. | |
| 2010/0015545 | A1 * | 1/2010 | Ueno et al. | 430/109.4 |

FOREIGN PATENT DOCUMENTS

| | | | |
|---|---|---|---|
| EP | 1 925 983 | A2 | 5/2008 |
| EP | 1 925 983 | A3 | 5/2008 |
| EP | 1990683 | A2 * | 11/2008 |
| EP | 2 015 143 | A1 | 1/2009 |
| JP | 2002 287427 | | 10/2002 |
| JP | 2004 287422 | | 10/2004 |
| JP | 2004 295110 | | 10/2004 |
| JP | 2006 154686 | | 6/2006 |
| JP | 2007 155978 | | 6/2007 |
| JP | 2007 292792 | | 11/2007 |
| JP | 2008 20631 | | 1/2008 |
| JP | 2008 116666 | | 5/2008 |
| JP | 2008 129411 | | 6/2008 |
| JP | 2008 129416 | | 6/2008 |
| JP | 2008 310280 | | 12/2008 |

OTHER PUBLICATIONS

International Search Report Issued Dec. 15, 2009 in PCT/JP09/065619 filed Sep. 2, 2009.

Extended European Search Report issued Oct. 9, 2012, in Application No. / Patent No. 09813049.5-1217 / 2324395 PCT/JP2009065619.

* cited by examiner

*Primary Examiner* — Christopher Rodee

(74) *Attorney, Agent, or Firm* — Oblon, Spivak, McClelland, Maier & Neustadt, L.L.P.

(57) ABSTRACT

A toner containing at least a binder resin, releasing agent, and colorant, wherein the binder resin contains polyester resin (A), polyester resin (B), and polyester resin (C), which is prepared by condensation-polymerizing (i) an alcohol component containing an alkylene oxide adduct of bisphenol compound and (ii) a carboxylic acid component; at least one of the polyester resin (A) and polyester resin (B) is a polyester resin prepared by condensation-polymerizing (i) the alcohol component substantially composed of only aliphatic alcohol and containing 1,2-propanediol in an amount of 65 mole % or more of a divalent alcohol component and (ii) the carboxylic acid component; and a softening point Tm(A) of the polyester resin (A) is 10 C or more higher than Tm(B) of the polyester resin (B), and the absolute difference between Tm(C) of the polyester resin (C) and the Tm(B) is 5° C. or less.

20 Claims, 2 Drawing Sheets

TONER AND DEVELOPER

This application is a 371 of PCT/JP2009/065619 filed Sep. 2, 2009. Priority to Japanese patent application 2008-234345, filed Sep. 12, 2008, is claimed.

TECHNICAL FIELD

The present invention relates to a toner suitable for use in an ultra high-speed printing system which can be used in print on demand (POD) technology especially using an electrophotographic printing method and to a developer using the toner.

BACKGROUND ART

In recent years, market demand for energy saving and increases in speed has increased for image forming apparatuses such as printers, copiers, and facsimiles. With the increase of the market demand, also in the field of electrophotographic toner (hereinafter, may be simply referred to as "toner"), demand for a toner having excellent low-temperature fixing property increases, and at the same time, there is increased needs for a toner having property opposing to low-temperature fixing property, such as anti-offset property and heat resistance-storage stability (blocking resistance), increase.

In order to meet these demand and needs, a variety of toners using aromatic polyester resins are proposed, but they have a disadvantage in that they are poor in pulverizability in their production process. Then, to address the problem, a method is proposed in which a low-molecular weight polyester prepared using an aliphatic alcohol that is excellent in pulverizability as a monomer is blended with a highly polymeric polyester (see PTL1). However, when the low-molecular weight polyester prepared using an aliphatic alcohol is used, the heat resistance-storage stability of the toner is degraded because the polyester resin has a low glass transition temperature due to its structure and it is difficult to satisfy, at a high level, both low-temperature fixing property, anti-offset property and heat resistance-storage stability.

In contrast to this, a toner is proposed wherein as a binder resin a polyester resin is used which is composed of (i) an alcohol component composed of a branched-chain aliphatic alcohol, such as 1,2-propanediol and (ii) a carboxylic acid component (see PTL2 and PTL3). The toner exhibits excellent low-temperature fixing property when used in a wide variety of image forming apparatuses from conventional low-speed machines to high-speed machines, and the toner is excellent in that it can achieve, at a high level, both low-temperature fixing property, anti-offset property and heat-resistance storage stability. Since the toner is also excellent in pulverizability, it can advantageously achieve high productivity of a toner produced by pulverization.

Meanwhile, in recent years in the print industry, print on demand (POD) technology which does not require a step of plate making has been developed. It is anticipated that the POD technology using an electrophotographic printing method can be used as an alternative to simple printing technology ("keiinsatu"), because the POD technology is well suited for printing of a small number of copies and for variable printing. However, the printing market of the print industry requests a higher level of print quality than the conventional market requests for prints produced by conventional copiers, etc. The image forming apparatuses using the electrophotgraphic printing method have some points to be addressed in view of this fact. One of them is to meet demand for developing, for image forming apparatuses used in the POD technology, an ultra high-speed printing system that operates at a significantly faster printing speed than the conventional high-speed copiers. The other is to meet demand for developing a continuous form paper output system with which nonlimiting, a wide variety of recording media, including crimp postcards, pre-printed forms, and address labels for direct mails can be processed. Thus, it further becomes necessary to meet demand for a toner which has excellent fixing property even with smaller heat input than the heat input which has been provided for a low-temperature fixing toner such as used in conventional copiers. Particularly when pages of printed forms or bound printed matter are flipped over and the printed images thereon are strongly rubbed by the user's hand, the user's hand or the printed images on the pages is easily smeared with the toner, which requires the printed images on the printed forms or bound printed matter to have more excellent smear resistance than the images printed by means of conventional copiers. In other words, it further requests the fixed images to have a low friction coefficient (reduction in μ of the fixed images).

In contrast to this, a toner is proposed wherein the fixing property of the toner and the smear resistance of the fixed images are increased by incorporating an alkylene oxide compound having a particular structure into the toner (see PTL4 and PTL5). However, the alkylene oxide compound is used as a surfactant in these proposed toners, and this process is only applicable in practice to a method in which a toner is polymerized and is ineffective for a method in which a toner is kneaded and pulverized.

Furthermore, a toner is proposed wherein a crystalline polyester resin and as an external additive a fine fluorine resin powder are used (see PTL6). However, in the proposed toner the fine fluorine resin powder decreases low-temperature fixing property, as well as, in the production process of the proposed toner, the proposed toner using the crystalline polyester resin exhibits poorer pulverizability than the toner using a polyester resin containing an aliphatic alcohol and an additional step of controlling the degree of crystallization is required.

Therefore at present it is desired that a toner is provided which may achieve both low-temperature fixing property, anti-offset property, and heat-resistance storage stability at such a level that the toner can be used in an ultra high-speed fixing system, can achieve particularly a low friction coefficient in fixed images (reduction in μ of the fixed images), and has excellent productivity.

CITATION LIST

Patent Literature

[PTL1] Japanese Patent Application Laid-Open (JP-A) No. 2002-287427
[PTL2] JP-A No. 2007-155978
[PTL3] JP-A No. 2008-129411
[PTL4] JP-A No. 2004-287422
[PTL5] JP-A No. 2004-295110
[PTL6] JP-A No. 2008-116666

SUMMARY OF INVENTION

An object of the present invention is to provide a toner which may achieve both low-temperature fixing property, anti-offset property, and heat-resistance storage stability at such a level that the toner can be used in an ultra high-speed fixing system, can achieve particularly a low friction coefficient in fixed images (reduction in μ of the fixed images), and has excellent productivity, and to provide a developer using the toner.

Means for solving the above-mentioned problems are as follows.

<1> A toner containing at least a binder resin, a releasing agent, and a colorant, wherein the binder resin contains polyester resin (A), polyester resin (B), and polyester resin (C), which is prepared by condensation-polymerizing (i) an alcohol component containing an alkylene oxide adduct of a bisphenol compound represented by the following general formula (1) and (ii) a carboxylic acid component; at least one of the polyester resin (A) and the polyester resin (B) is a polyester resin prepared by condensation-polymerizing (i) the alcohol component substantially composed of only aliphatic alcohol and containing 1,2-propanediol in an amount of 65 mole % or more of a divalent alcohol component and (ii) the carboxylic acid component; and a softening point Tm(A) of the polyester resin (A) is 10° C. or more higher than a softening point Tm(B) of the polyester resin (B), and the absolute difference between a softening point Tm(C) of the polyester resin (C) and the softening point Tm(B) of the polyester resin (B) is 5° C. or less, General formula (1)

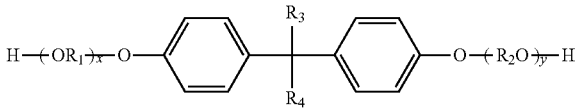

where $R_1$ and $R_2$ each represent a C2-C4 alkylene group; $R_3$ and $R_4$ are selected from a hydrogen atom, a C1-C6 straight-chain alkyl group, and a C1-C6 branched-chain alkyl group; and x and y each represent a positive integer and the sum of x and y is 1 to 16.

<2> The toner according to the item <1>, wherein both of the polyester resin (A) and the polyester resin (B) are polyester resins prepared by condensation-polymerizing (i) an alcohol component substantially composed of only aliphatic alcohol and containing 1,2-propanediol constituting 65 mole % or more of a divalent alcohol component and (ii) a carboxylic acid component.

<3> The toner according to one of the items <1> and <2>, wherein a mass ratio [(C)/((A)+(B))] of the polyester resin (C) to the polyester resin (A) and the polyester resin (B) is 1/9 to 6/4.

<4> The toner according to any one of the items <1> to <3>, wherein a mass ratio [(A)/(B)] of the polyester resin (A) to the polyester resin (B) is 1/9 to 9/1.

<5> The toner according to any one of the items <1> to <4>, wherein the alcohol component of at least one of the polyester resin (A) and the polyester resin (B) further comprises 1,3-propanediol.

<6> The toner according to any one of the items <1> to <5>, wherein the carboxylic acid component of at least one of the polyester resin (A) and the polyester resin (B) contains a C2-C5 aliphatic dicarboxylic acid compound.

<7> The toner according to any one of the items <1> to <6>, wherein the polyester resin (C) is prepared by condensation-polymerizing (i) the alcohol component containing an alkylene oxide adduct of a bisphenol compound represented by the general formula (I), in an amount of 80 mole % or more of a divalent alcohol component, and (ii) the carboxylic acid component.

<8> The toner according to any one of the items <1> to <7>, wherein the softening point Tm(B) of the polyester resin (B) is 80° C. or more and less than 120° C.

<9> The toner according to any one of the items <1> to <8>, wherein the at least one of the polyester resin (A) and the polyester resin (B) has an acid value of 25 mgKOH/g to 70 mgKOH/g, and the polyester resin (C) has an acid value of 1 mgKOH/g to 25 mgKOH/g.

<10> A developer containing at least a toner according to any one of the items <1> to <9>, and a carrier.

According to the present invention, the problems of the prior art can be solved, and a toner which may achieve both low-temperature fixing property, anti-offset property, and heat-resistance storage stability at such a level that the toner can be used in an ultra high-speed fixing system, can achieve particularly a low friction coefficient in fixed images (reduction in μ of the fixed images), and has excellent productivity, and a developer using the toner may be provided.

DESCRIPTION OF EMBODIMENTS (Toner)

Figure 1:
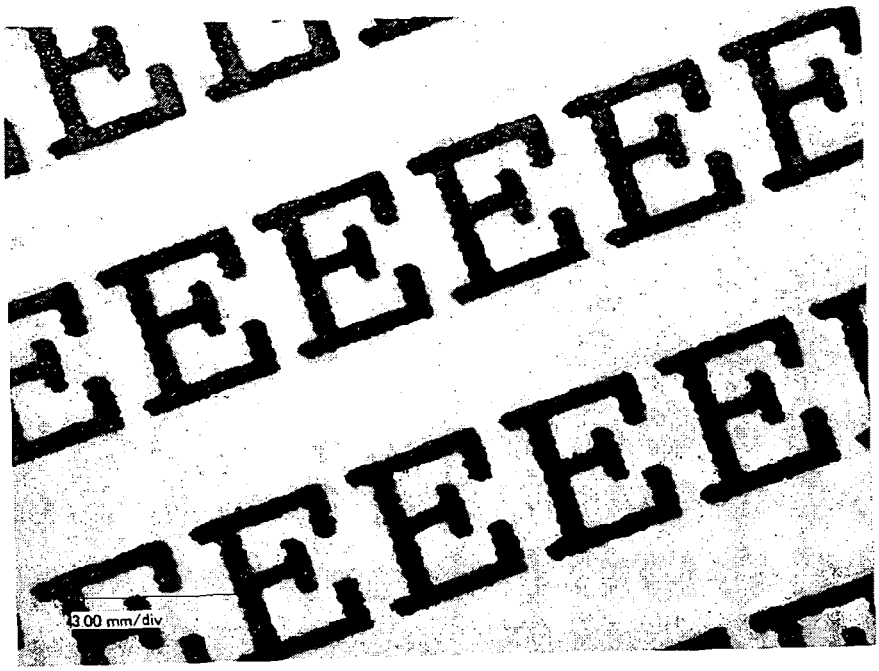
FIG. 1 is a photograph of an image which was formed with a toner of Example 1 and evaluated as having no smear (A) after rubbing in evaluation criteria for smear resistance.

The toner of the present invention contains at least a binder resin, a releasing agent and a colorant, contains a charge control agent and external additives, and further contains other components as required.

<Binder Resin>

The binder resin contains polyester resin (A), polyester resin (B), and polyester resin (C).

The softening point of the polyester resin (A) and the softening point of the polyester resin (B) are designated as Tm(A) and Tm(B), respectively. In large part, the softening point Tm(A) contributes to enhancing anti-hot offset property and the softening point Tm(B) contributes to enhancing low-temperature fixing property. For this reason, in order for the toner to have an excellent fixing temperature range, it is at least necessary that the softening point Tm(A) is 10° C. or more higher than the softening point Tm(B), and, further, Tm(A) is preferably 15° C. to 55° C. higher than Tm(B), and more preferably Tm(A) is 20° C. to 50° C. higher than Tm(B). When the difference between Tm(A) and Tm(B) is less than 10° C., cold offset or hot offset may readily occur, because the temperature range within which the toner can be fixed is reduced.

More specifically, in terms of achieving both low-temperature fixing property, anti-hot offset property, and heat resistance storage stability, the polyester resin (A) has preferably a softening point Tm(A) of 120° C. to 160° C., more preferably 130° C. to 155° C., and particularly preferably 135° C. to 155° C. Meanwhile, the polyester resin (B) has preferably a softening point Tm(B) of 80° C. or more and less than 120° C., more preferably 85° C. to 115° C., and particularly preferably 90° C. to 110° C.

In particular, more preferably the softening point Tm(B) is in the above-mentioned range, because it affects the smear resistance of fixed images (reduction in μ of the fixed images), improvement of the smear resistance which is an aim of the present invention.

It is necessary that the absolute difference of a softening point Tm(C) of the polyester resin (C) and the softening point Tm(B) of the polyester resin (B) is 5° C. or less. Setting the range of the softening point Tm(C) as mentioned above makes the compatibility of the polyester resin (C) with the polyester resin (B) at the time of mixing the binder resins improved as much as possible, without impairing low-temperature fixing property of the toner through effects of the polyester resin (C). When the absolute difference of the softening points is more than 5° C., the low-temperature fixing property is degraded due to an excessively high softening point of the polyester resin (C), or each resin becomes easy to undergo phase separation, leading to degradation of pulverizability and nonuniform compositions of toner particles.

—Polyester Resins (A) and (B)—

At least one of the polyester resin (A) and the polyester resin (B) is a polyester resin prepared by condensation-polymerizing (i) an alcohol component substantially composed of only aliphatic alcohol and containing 1,2-propanediol in an amount of 65 mole % or more of a divalent alcohol component and (ii) a carboxylic acid component. In this case it is preferred that both of the polyester resin (A) and the polyester resin (B) be polyester resins prepared by condensation-polymerizing (i) the alcohol component substantially composed of only aliphatic alcohol and containing 1,2-propanediol in an amount of 65 mole % or more of a divalent alcohol component and (ii) the carboxylic acid component.

—Alcohol Component—

The 1,2-propanediol, which is a branched chain alcohol having 3 carbon atoms, used in the alcohol component is effective in improving low-temperature fixing property while maintaining anti-offset property, when compared to an alcohol having 2 or less carbon atoms, and is effective in preventing reduction in storage stability accompanied by decrease in glass transition temperature when compared to a branched chain alcohol having 4 or more carbon atoms. The toner can be fixed at significantly low temperature, and both heat resistance storage stability and anti-hot offset property may be achieved by the use of the 1,2-propanediol. Particularly when the 1,2-propanediol constitutes 65 mole % or more of the divalent alcohol component, it exerts excellent low-temperature fixing property and anti-offset property.

The alcohol component of the polyester resin (A) and the polyester resin (B) may contain alcohols other than 1,2-propanediol within the range where the purposes and effects of the present invention are not impaired, however, the amount of 1,2-propanediol in the divalent alcohol component is 65 mole % or more, preferably 70 mole % or more, more preferably 80 mole % or more, and still more preferably 90 mole % or more.

Examples of divalent alcohol components other than the 1,2-propandiol include 1,3-propanediol, ethylene glycols having different numbers of carbon atoms, hydrogenated bisphenol A, bisphenol F, or aliphatic dialcohols such as alkylene (having 2 to 4 carbon atoms) oxide adducts (with average added moles: 1 to 16) thereof. The amount of a divalent alcohol compound in the alcohol component is preferably 60 mole % to 95 mole % and more preferably 65 mole % to 90 mole %.

The alcohol component of the polyester resin (A) and the polyester resin (B) preferably contains 1,3-propanediol in terms of anti-offset property. The molar ratio (1,2-propanediol/1,3-propanediol) of 1,2-propanediol to 1,3-propanediol in an alcohol component of the polyester resin (A) and the polyester resin (B) is preferably 99/1 to 65/35, more preferably 95/3 to 70/30, still more preferably 95/3 to 75/25.

When a trivalent or higher alcohol is incorporated into the alcohol component, the resulting toner containing the alcohol component becomes effective in improving anti-hot offset property. The amount of the trivalent or higher alcohol in the total amount of the alcohol component is preferably 20 mole % or less, and more preferably 5 mole % to 30 mole %. Examples of the trivalent or higher polyhydric alcohol compounds include glycerin, pentaerythritol, trimethylolpropane, sorbitol, or alkylene (having 2 to 4 carbon atoms) oxide adducts (with average added moles: 1 to 16) thereof. Among them, glycerin is preferable particularly in terms of maintaining low-temperature fixing property.

The alcohol component of the polyester resin (A) or the polyester resin (B) may contain aromatic alcohols including alkylene oxide adducts of bisphenol A such as polyoxypropylene (2,2)-2,2-bis(4-hydroxyphenyl) propane, and polyoxyethylene (2,2)-2,2-bis(4-hydroxyphenyl) propane, however, preferably the alcohol component of the polyester resin (A) or the polyester resin (B) is substantially composed of only aliphatic alcohol. Note that, in the present invention, the description "the alcohol component substantially composed of only aliphatic alcohol" means that the amount of the aliphatic alcohol in the alcohol component is 90 mole % or more.

—Carboxylic Acid Component—

The carboxylic acid component of the polyester resin (A) or the polyester resin (B) is not particularly limited, and can be appropriately selected depending on the purpose. Examples of the carboxylic acid compounds include benzene dicarboxylic acids such as phthalic acid, isophthalic acid, and terephthalic acid, or anhydrides thereof; alkyl dicarboxylic acids such as succinic acid, adipic acid, sebacic acid, and azelaic acid, or anhydrides thereof; unsaturated dibasic acids such as maleic acid, citraconic acid, itaconic acid, alkenylsuccinic acid, fumaric acid, and mesaconic acid; and unsaturated dibasic acid anhydrides such as maleic anhydrides, citraconic anhydrides, itaconic anhydrides, and alkenylsuccinic anhydrides. Examples of trivalent or higher polyhydric carboxylic acid compounds include trimellitic acid, pyromellitic acid, 1,2,4-benzene tricarboxylic acid, 1,2,5-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxy-2-methyl-2-methylenecarboxy propane, tetra(methylenecarboxy) methane, 1,2,7,8-octane tetracarboxylic acid, Enpol trimer acid, or their anhydrides and partial lower alkyl esters.

Of these, aromatic polyhydric carboxylic acid compounds such as phthalic acid, isophthalic acid, terephthalic acid, and trimellitic acid are preferably used in terms of heat resistance-storage stability and mechanical strength of resins. The amount of an aromatic polyhydric carboxylic acid compound in a carboxylic acid component of resins is preferably 40 mole % to 95 mole %, more preferably 50 mole % to 90 mole %, and still more preferably 60 mole % to 80 mole %.

A toner that is particularly excellent in pulverizability, low-temperature fixing property, and smear resistance can be obtained by incorporating a C2-C5 aliphatic dicarboxylic acid compound of the above-mentioned carboxylic acid compounds into the polyester resins. Examples of the C2-C5 aliphatic dicarboxylic acid compound include succinic acid, maleic acid, citraconic acid, itaconic acid, fumaric acid, mesaconic acid, maleic anhydrides, citraconic anhydrides, and itaconic anhydrides. Among them, particularly itaconic acid and itaconic anhydrides are preferably used. The amount of the C2-C5 aliphatic dicarboxylic acid compound in the carboxylic acid component is preferably 5 mole % to 60 mole %, more preferably 10 mole % to 50 mole %, and still more preferably 20 mole % to 40 mole %.

—Polyester Resin (C)—

The effects of the present invention are optimally exerted by using as a binder resin of the toner of the present invention the polyester resin (C) in combination with the above-mentioned polyester resin (A) and polyester resin (B), where effects due to individual polyester resins are synergistically exerted.

The polyester resin (C) is a polyester resin prepared by condensation-polymerizing (i) an alcohol component containing an alkylene oxide adduct of a bisphenol compound represented by the following general formula (I) and (ii) a carboxylic acid component:

General formula (1)

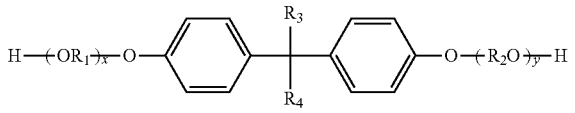

where $R_1$ and $R_2$ each represent a C2-C4 alkylene group, such as an ethylene group or a propylene group; $R_3$ and $R_4$ each represent a hydrogen atom, a C1-C6 straight-chain alkyl group, or a C1-C6 branched-chain alkyl group, such as a methyl group, an ethyl group, a propyl group, an isopropyl group, a butyl group, a t-butyl group, and a hexyl group; and x and y each represent a positive integer and the sum of x and y is 1 to 16, and particularly preferably 2 to 6.

—Alcohol Component—

Examples of an alkylene oxide adduct of a bisphenol compound represented by the general formula (I) include diols obtained by allowing a cyclic ether, such as ethylene oxide and propylene oxide, to polymerize with a bisphenol compound, such as bisphenol A and bisphenol F.

So long as the purposes and effects of the present invention are not impaired, alcohols other than the compounds represented by the above general formula (I) may be contained in an alcohol component of the polyester resin (C). The amount of the compound of the general formula (I) is preferably 80 mole % or more in a divalent alcohol component.

—Carboxylic Acid Component—

The carboxylic acid component of the polyester resin (C) is not particularly limited, and can be appropriately selected depending on the purpose from such carboxylic acid compounds that are mentioned above and that can be used in the polyester resin (A) or the polyester resin (B).

—Esterification Catalyst—

A condensation polymerization reaction between an alcohol component and a carboxylic acid component for each of the polyester resin (A), the polyester resin (B), and the polyester resin (C) is preferably carried out in the presence of an esterification catalyst.

Examples of the esterification catalyst include Lewis acids such as p-toluene sulfonic acid; titanium compounds; and tin (II) compounds having no Sn—C bond. These esterification catalysts may be used alone or two of them may be used in combination. In the present invention, at least one of titanium compounds and tin (II) compounds having no Sn—C bond is preferable.

For the titanium compound, a titanium compound having a Ti—O bond is preferable, and a compound containing an alkoxy group, an alkenyloxy group or an acyloxy group each having the total carbon atoms of 1 to 28 is more preferable.

Examples of the titanium compound include titanium diisopropylate bis(triethanolaminate) [Ti $(C_6H_{14}O_3N)_2(C_3H_7O)_2$], titanium diisopropylate bis(diethanolaminate) [Ti $(C_4H_{10}O_2N)_2(C_3H_7O)_2$], titanium dipentylate bis(triethanolaminate) [Ti $(C_6H_{14}O_3N)_2(C_5H_{11}O)_2$], titanium diethylate bis(triethanolaminate) [Ti $(C_6H_{14}O_3N)_2(C_2H_5O)_2$], titanium dihydroxy octylate bis(triethanolaminate) [Ti $(C_6H_{14}O_3N)_2(OHC_8H_{16}O)_2$], titanium distearate bis(triethanolaminate) [Ti $(C_6H_{14}O_3N)_2(C_{18}H_{37}O)_2$], titanium triisopropylate triethanolaminate [Ti $(C_6H_{14}O_3N)_1(C_3H_7O)_3$], and titanium monopropylate tris(triethanolaminate) [Ti $(C_6H_{14}O_3N)_3(C_3H_7O)_1$]. Of these, titanium diisopropylate bis(triethanolaminate), titanium diisopropylate bis(diethanolaminate), and titanium dipentylate bis(triethanolaminate) are preferable. These titanium compounds are commercially available from Matsumoto Trading Co., Ltd.

Specific preferred examples of other titanium compounds include tetra-n-butyltitanate [Ti $(C_4H_9O)_4$], tetrapropyl titanate [Ti $(C_3H_7O)_4$], tetrastearyl titanate [Ti $(C_{18}H_{37}O)_4$], tetramyristyl titanate [Ti $(C_{14}H_{29}O)_4$], tetraoctyl titanate [Ti $(C_8H_{17}O)_4$], dioctyl dihydroxyoctyl titanate [Ti $(C_8H_{17}O)_2(OHC_8H_{16}O)_2$], and dimyristyl dioctyl titanate [Ti $(C_{14}H_{29}O)_2(C_8H_{17}O)_2$]. Of these, tetrastearyl titanate, tetramyristyl titanate, tetraoctyl titanate, and dioctyl dihydrooxyoctyl titanate are preferable. These titanium compounds can be obtained, for example, by reacting titanium halide with a corresponding alcohol and are commercially available from NISSO Co., Ltd.

The existing amount of the titanium compound to 100 parts by mass of the total amount of the alcohol component and the carboxylic acid component is preferably 0.01 parts by mass to 1.0 part by mass and more preferably 0.1 parts by mass to 0.7 parts by mass.

For the tin (II) compound having no Sn—C bond, a tin (II) compound having an Sn—O bond, a tin (II) compound having an Sn—X (X indicates a halogen atom) bond and the like are preferable, and a tin (II) compound having an Sn—O bond is more preferable.

Examples of the tin (II) compound having an Sn—O bond include tin (II) carboxylate containing a carboxylic group having 2 to 28 carbon atoms such as tin (II) oxalate, tin (II) diacetate, tin (II) dioctanoate, tin(II) dilaurate, tin(II) distearate, and tin(II) dioleate; dialkoxy tin (II) containing an alkoxy group having 2 to 28 carbon atoms such as dioctyloxy tin (II), dilauroxy tin (II), distearoxy tin (II), and dioleyloxy tin (II); tin (II) oxides; and tin (II) sulfates.

Examples of the tin (II) compound having an Sn—X (X indicates a halogen atom) bond include tin (II) halides such as tin (II) chloride, and tin (II) bromide. Of these, in terms of advantageous effect of charge start-up and catalytic capability, aliphatic tin (II) represented by $(R_1COO)_2Sn$ ($R_1$ represents an alkyl group or an alkenyl group having 5 to 19 carbon atoms), dialkoxy tin (II) represented by $(R_2O)_2Sn$ ($R_2$ represents an alkyl group or an alkenyl group having 6 to 20 carbon atoms), and tin (II) oxide represented by SnO are preferable; aliphatic tin (II) represented by $(R_1COO)_2Sn$ and tin (II) oxide are more preferable; and tin (II) dioctanoate, tin(II) distearate, and tin(II) oxide are particularly preferable.

The existing amount of the tin (II) compound having no Sn—C bond to 100 parts by mass of the total amount of the alcohol component and the carboxylic acid component is preferably 0.01 parts by mass to 1.0 part by mass, and more preferably 0.1 parts by mass to 0.7 parts by mass.

When the titanium compound is used in combination with the tin(II) compound having no Sn—C bond, the total existing amount of the titanium compound and the tin (II) compound to 100 parts by mass of the total amount of the alcohol component and the carboxylic acid component is preferably 0.01 parts by mass to 1.0 part by mass, and more preferably 0.1 parts by mass to 0.7 parts by mass.

A condensation polymerization reaction between the alcohol component and the carboxylic acid component can be carried out, for example, in the presence of the esterification catalyst under an inert gas atmosphere at a temperature of 180° C. to 250° C.

The toner of the present invention can achieve both low-temperature fixing property, anti-hot offset property, and heat-resistance storage stability, and can achieve smear resistance of fixed images (reduction in μ of the fixed images), which is the largest effect of the present invention, by incorporating in combination the polyester resin (A), the polyester resin (B), and the polyester resin (C) each satisfying the above conditions. The mechanism how the use of these polyester resins makes the toner achieve the above effects is uncertain, however, the mechanism may be possibly explained as follows: since in a mixture of the polyester resin (A) and the polyester resin (B), which are 1,2-propanediol resins and therefore are excellent in dispersing a releasing agent while reducing the amount of the releasing agent exuding on the surface of fixed images, the polyester resin (C), from which the releasing agent easily exudes, is dispersed in a state of microphase separation, the friction coefficient of the surface of the fixed images is reduced by the increased exudation of the releasing agent on the surface of the fixed images due to the polyester resin (C), while the 1,2-propanediol resins maintain both the fixing property and the heat-resistance storage stability in an excellent manner and maintain pulverizability. It is considered that the mechanical strength of the fixed images is also increased by the bisphenol skeleton having high mechanical strength.

Therefore, simple use of a binder resin having both a 1,2-propanediol skeleton and a bisphenol skeleton in each molecule cannot achieve the effects of the present invention which effects are realized by the use of a binder resin containing the polyester resin (A), the polyester resin (B), and the polyester resin (C).

Further, conditions for satisfying both low-temperature fixing property, anti-hot offset property, and heat-resistance storage stability are that the mass ratio [(A)/(B)] of the polyester resin (A) to the polyester resin (B) is preferably 1/9 to 9/1, more preferably 2/8 to 8/2, and still more preferably 3/7 to 7/3. Further, the mass ratio [(C)/((A)+(B))] of the polyester resin (C) to the polyester resins (A) and (B) is preferably 1/9 to 6/4.

The glass transition temperatures of the polyester resin (A), the polyester resin (B), and the polyester resin (C) are preferably 45° C. to 75° C., and more preferably 50° C. to 70° C. in terms of fixing property, heat-resistance storage stability, and durability.

In terms of low-temperature fixing property, anti-hot offset property, and heat-resistance storage stability, the amount of a low molecular weight component having a molecular weight of 500 or lower and originating from a residual monomer component or a residual oligomer component is preferably 12% or less, more preferably 10% or less, still preferably 9% or less, and still more preferably 8% or less of the amount of polyester resins. The amount of the low molecular weight component in the total amount of polyester resins is determined from a ratio of peak areas of molecular weights detected by a gel permeation chromatography (GPC) described later.

The acid values of the polyester resin (A), the polyester resin (B), and the polyester resin (C) are preferably 1 mgKOH/g to 70 mgKOH/g. When the acid value of at least one of the polyester resin (A) and the polyester resin (B) is 25 mgKOH/g to 70 mgKOH/g and the acid value of the polyester resin (C) is 1 mgKOH/g to 25 mgKOH/g, dispersion state of each resin becomes optimal and smear resistance of fixed images are improved. Particularly preferably, the acid value of at least one of the polyester resin (A) and the polyester resin (B) is 25 mgKOH/g to 40 mgKOH/g, and the acid value of the polyester resin (C) is 3 mgKOH/g to 18 mgKOH/g.

Note that in the present invention a "polyester resin" means a resin having a "polyester unit". A "polyester unit" indicates a unit having a polyester structure, and a "polyester resin" includes not only a polyester but also a polyester that is modified to such a degree that the properties of polyester are substantially maintained. In the present invention, preferably any one of the polyester resin (A), the polyester resin (B), and the polyester resin (C) is the modified polyester. Examples of the modified polyester include a polyester that is produced by graft polymerization or block polymerization with a phenol compound, an urethane compound, an epoxy compound or the like according to methods described in, for example, JP-A Nos. 11-133668, 10-239903, and 08-20636, and a composite resin having two or more resin units containing a polyester unit.

In the present invention, preferably the polyester resin (A), the polyester resin (B), and the polyester resin (C) are amorphous polyesters, which differ from crystalline polyesters. In the present invention, the words "amorphous resin" mean a resin having a difference in temperature of 30° C. or more between the softening point and the glass transition temperature (Tg).

Further, in the present invention the binder resin may contain a resin other than the polyester resin (A), the polyester resin (B), and the polyester resin (C) as long as the effects of the present invention are not impaired. The resin other than the polyester resins (A), (B), and (C) may include, for example, polyester resins; and known binder resins, such as, vinyl resins such as styrene-acryl resins, epoxy resins, polycarbonates, polyurethanes, composite resins each having two or more resin units of which one is a polyester unit (may also be referred to as "hybrid resins").

<Releasing Agent>

The releasing agent is not particularly limited, can be appropriately selected depending on the purpose from those known in the art, and may include, for example, waxes such as carbonyl group-containing waxes, polyolefin waxes, and long-chain hydrocarbons. These may be used alone or in combination. Among these, carbonyl group-containing waxes are preferred.

Examples of the carbonyl group-containing waxes include polyalkanoic acid esters, polyalkanol esters, polyalkanoic acid amides, polyalkyl amides, and dialkyl ketones. Examples of the polyalkanoic acid esters include carnauba waxes, montan waxes, trimethylolpropane tribehenate, pentaerythritol tetrabehenate, pentaerythritol diacetate dibehenate, glycerine tribehenate, and 1,18-octadecanediol distearate. Examples of the polyalkanol esters include trimellitic acid tristearyl, and distearylmaleate. Examples of the polyalkanoic acid amides include dibehenylamides. Examples of the polyalkyl amides include trimellitic acid tristearylamide. Examples of the dialkyl ketones include distearyl ketone.

Among these carbonyl group-containing waxes, polyalkanoic acid esters are particularly preferred.

Examples of the polyolefin waxes include polyethylene waxes and polypropylene waxes.

Examples of the long-chain hydrocarbons include paraffin waxes and sasol waxes.

The melting points of the releasing agents are not particularly limited, may be appropriately selected depending on the purpose, and are preferably 40° C. to 160° C., more preferably 50° C. to 120° C., and particularly preferably 60° C. to 90° C. When the melting point is less than 40° C., heat-resistance storage stability may be disadvantageously affected. When the melting point is more than 160° C., cold offset may easily be caused at the time of fixation at a low temperature.

The melting point of the releasing agent can be determined, for example, as the temperature of the maximum peak of melting heat detected when the temperature of a sample is increased at a temperature increasing rate of 10° C./min after the temperature of the sample has been increased to 200° C. and then cooled at a temperature decreasing rate of 10° C./min from 200° C. to 0° C., using a differential scanning calorimeter (DSC210, manufactured by Seiko Instruments Inc.).

The melt viscosity of the releasing agent as measured at a temperature 20° C. higher than the melting point of the wax is preferably 5 cps to 1,000 cps, and more preferably 10 cps to 100 cps. When the melt viscosity is less than 5 cps, releasing property may degrade. When the melt viscosity is more than 1,000 cps, anti-hot offset property or low-temperature fixing property may not be improved.

The amount of the releasing agent in the toner is not particularly limited, may be appropriately selected depending on the purpose, and is preferably 40% by mass or less, and more preferably 3% by mass to 30% by mass.

When the amount is more than 40% by mass, flowability of the toner may degrade.

<Colorant>

The colorant is not particularly limited and may be appropriately selected from conventional dyes and pigments depending on the purpose. Examples thereof include carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. These colorants may be used alone or in combination.

Color of the colorant is not particularly limited and may be appropriately selected depending on the purpose. For example, black colorants and color colorants are exemplified. These colorants may be used alone or in combination.

Examples of colorant pigments for black ink include carbon black (C.I. Pigment Black 7) colorants such as furnace black, lamp black, acetylene black, and channel black; metals such as copper, iron (C.I. Pigment Black 11), and titanium oxide; and organic pigments such as aniline black (C.I. Pigment Black 1).

Examples of colorants for magenta ink include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 163, 177, 179, 202, 206, 207, 209, and 211; C.I. Pigment Violet 19; C.I. Vat Red 1, 2, 10, 13, 15, 23, 29, and 35.

Example of colorant pigments for cyan ink include C.I. Pigment Blue 2, 3, 15, 15:1, 15:2, 15:3, 15:4, 15:6, 16, 17, 60; C.I. Vat Blue 6; C.I. Acid Blue 45 or copper phthalocyanine pigment in which phthalocyanine skeleton is substituted with one to five phthalimidemethyl groups, C.I. Pigment Green 7 and Green 36.

Examples of colorant pigments for yellow ink include C.I. Pigment Yellow 0-16, 1, 2, 3, 4, 5, 6, 7, 10, 11, 12, 13, 14, 15, 16, 17, 23, 55, 65, 73, 74, 83, 97, 110, 151, 154, and 180; C.I. Vat Yellow 1, 3, and 20; and C.I. Pigment Orange 36.

The amount of the colorant in the toner is not particularly limited and may be appropriately selected depending on the purpose, however, it is preferably 1% by mass to 15% by mass, and more preferably 3% by mass to 10% by mass. When the amount of the colorant is less than 1% by mass, a reduction of tinting strength of the toner is observed, and when the amount of the colorant is more than 15% by mass, a dispersion defect of the pigment may take place in the toner to cause a reduction of tinting strength and a reduction of electrical properties of the toner.

The colorant may be used as a masterbatch obtained by combining the colorant and a resin. The resin is not particularly limited and may be appropriately selected from those known in the art depending on the purpose. Examples of the resin include polymers of styrene or substituted styrene, styrene-based copolymers, polymethyl methacrylate resins, polybutyl methacrylate resins, polyvinyl chloride resins, polyvinyl acetate resins, polyethylene resins, polypropylene resins, polyester resins, epoxy resins, epoxy polyol resins, polyurethane resins, polyamide resins, polyvinyl butyral resins, polyacrylate resins, rosins, modified rosins, terpene resins, aliphatic hydrocarbon resins, alicyclic hydrocarbon resins, aromatic series petroleum resins, chlorinated paraffins, and paraffins. These resins may be used alone or in combination.

Examples of the polymers of styrene or substituted styrene include polyester resins, polystyrene resins, poly-(p-chlorostyrene) resins, and polyvinyl toluene resins. Examples of the styrene-based copolymers include styrene-p-chlorostyrene copolymers, styrene-propylene copolymers, styrene-vinyltoluene copolymers, styrene-vinylnaphthaline copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-α-methyl chloromethacrylate copolymers, styrene-acrylonitrile copolymers, styrene-vinylmethylethylketone copolymers, styrene-butadiene copolymers, styrene-isoprene copolymers, styrene-acrylonitrile-indene copolymers, styrene-maleic acid copolymers, and styrene-maleate copolymers.

The masterbatch may be obtained by mixing and kneading the resin for masterbatch and the colorant under the application of high shear force. At this time, it is preferable to use an organic solvent to enhance the interaction between the colorant and the resin. A so-called flashing method, where aqueous paste containing colorant and water is mixed or kneaded with a resin and an organic solvent to transfer the colorant to the resin, and water and organic solvent component are removed, may also be preferably used because a wet cake of the colorant may be directly used without drying the cake. For the mixing and kneading, a high-shearing dispersion apparatus such as a triple roll mill is preferably used.

—Charge Controlling Agent—

The charge controlling agent is not particularly limited and may be appropriately selected from those known in the art depending on the purpose. However, when a colored material is used, the color tone may be changed. Therefore, a colorless or near white material is preferable. Examples of such a charge controlling agent include triphenylmethane dyes, molybdic acid chelate pigments, Rhodamine series dyes, alkoxy-based amines, quaternary ammonium salts (including fluorine-modified quaternary ammonium salts), alkylamide, single substance or compounds of phosphorus, single substance or compounds of tungsten, fluorine surfactants, metal salicylates, and metal salts of salicylic acid derivatives. These charge controlling agents may be used alone or in combination.

For the charge controlling agent, a commercially available product may be used. Examples thereof include BONTRON P-51 (quaternary ammonium salt), E-82 (oxynaphthoic acid metal complex), E-84 (salicylic acid metal complex), and E-89 (phenolic condensation product), which are manufactured by Orient Chemical Industries, Ltd.; TP-302 and TP-415 (quaternary ammonium salt molybdenum complex), which are manufactured by Hodogaya Chemical Co., LTD.; COPY CHARGE PSY VP2038 (quaternary ammonium salt), COPY BLUE PR (triphenylmethane derivative), COPY CHARGE NEG VP2036, and COPY CHARGE NX VP434 (quaternary ammonium salt), which are manufactured by Hoechst AG; LRA-901, and LR-147 (boron complex), which are manufactured by Japan Carlit Co., Ltd.; quinacridone, azo pigments; and polymer compounds having a functional group such as a sulfonate group, a carboxyl group, or a quaternary ammonium salt group.

The charge controlling agent may be melted and kneaded with the masterbatch and dissolved and/or dispersed therein, or may be added into the solution or dispersion which is produced by directly dissolving and/or dispersing in the organic solvent each of the toner components, or may be fixed on the surface of toner after toner particles are produced.

The amount of the charge controlling agent in the toner varies depending on the type of the binder resin, presence or absence of additives, dispersing method, etc. and cannot be unequivocally defined, however, for example, to 100 parts by mass of the binder resin, it is preferably 0.1 parts by mass to 10 parts by mass, and more preferably 0.2 parts by mass to 5 parts by mass. When the amount of the charge controlling agent is less than 0.1 parts by mass, charge controlling property may not be achieved, and when the amount of the charge controlling agent is more than 10 parts by mass, the chargeability of the toner is excessively increased to reduce the effect of the main charge controlling agent, and the electrostatic attraction force to the developing roller is increased, which may cause a reduction in flowability of the developer and/or a reduction in image density.

—External Additive—

The external additive is not particularly limited and may be appropriately selected from those known in the art depending on the purpose. Examples thereof include fine silica particles, hydrophobized silicas, aliphatic metal salts (such as zinc stearate, and aluminum stearate); metal oxides (such as titania, alumina, tin oxide, and antimony oxide), and fluoropolymers. Of these, fine hydrophobized silica particles, fine hydrophobized titania particles, fine hydrophobized titanium oxide particles and fine hydrophobized alumina particles are preferably exemplified.

Examples of the fine silica particles include HDK H 2000, HDK H 2000/4, HDK H 2050EP, HVK21, and HDK H 1303 (all manufactured by Hoechst AG); and R972, R974, RX200, RY200, R202, R805, and R812 (all manufactured by Japan AEROSIL Inc.). Examples of the fine titania particles include P-25 (manufactured by Japan AEROSIL Inc.); STT-30, and STT-65C-S (both manufactured by Titanium Kogyo K.K.); TAF-140 (manufactured by Fuji Titanium Kogyo K.K.); and MT-150W, MT-500B, MT-600B, and MT-150A (all manufactured by Teika Co., Ltd.). Examples of the fine hydrophobized titanium oxide particles include T-805 (manufactured by Japan AEROSIL Inc.); STT-30A, and STT-65S-S (both manufactured by Titanium Kogyo K.K.); TAF-500T, and TAF-1500T (both manufactured by Fuji Titanium Kogyo K.K.); MT-100S and MT-100T (both manufactured by Teika Co., Ltd.); and IT-S (manufactured by Ishihara Sangyo Kaisha Ltd.).

The fine hydrophobized oxide particle, fine hydrophobized silica particle, fine hydrophobized titania particle and fine hydrophobized alumina particle can be obtained by treating a fine hydrophilic particle with a silane coupling agent such as methyl trimethoxy silane, methyl triethoxy silane, and octyl trimethoxy silane. Further, a fine silicone oil-treated oxide particle or fine silicone oil-treated inorganic particle in which a silicone oil is added to a fine inorganic particle under application of heat if necessary, is also preferably used.

Examples of the silicone oil include dimethyl silicone oil, methylphenyl silicone oil, chlorphenyl silicone oil, methylhydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercaptane-modified silicone oil, acryl or methacryl-modified silicone oil, and α-methylstyrene-modified silicone oil.

Examples of the fine inorganic particle include silica, alumina, titanium oxide, barium titanate, magnesium titanate, calcium titanate, strontium titanate, iron oxide, copper oxide, zinc oxide, tin oxide, silica sand, clay, mica, wollastonite, silious earth, chrome oxide, cerium oxide, red iron oxide, antimony trioxide, magnesium oxide, zirconium oxide, barium sulfate, barium carbonate, calcium carbonate, silicon carbide, and silicon nitride. Of these, silica, and titanium dioxide are particularly preferable.

The amount of the external additive added is preferably 0.1% by mass to 5% by mass, and more preferably 0.3% by mass to 3% by mass in the total amount of the toner. The average particle diameter of primary particle of the fine inorganic particle is preferably 100 nm or less, and more preferably 3 nm to 70 nm. When the average particle diameter is smaller than this range, the fine inorganic particle is buried in the toner and it may be difficult that the function is effectively exerted, and when the average particle diameter is larger than this range, it may unevenly damage the surface of a latent electrostatic image bearing member. For the external additive, the fine inorganic particle and a fine hydrophobized inorganic particle may be used in combination, and preferably the average particle diameter of the primary particle that has been hydrophobized is 1 nm to 100 nm, and more preferably at least two types of the fine inorganic particles particularly having an average diameter of 5 nm to 70 nm are contained. Further, it is more preferable that at least two fine inorganic particles having an average particle diameter of their hydrophobized primary particles of 20 nm or less be contained and at least one fine inorganic particle having an average particle diameter of the hydrophobized primary particle of 30 nm or more be contained. The specific surface of the fine inorganic particles measured by BET method is preferably 20 $m^2/g$ to 500 $m^2/g$.

Examples of a surface treatment agent for the external additive containing the fine oxide particle include silane coupling agents such as dialkyl halogenated silane, trialkyl halogenated silane, alkyl tri-halogenated silane, hexaalkyldisilazane, silylation agents, silane coupling agents having an alkyl fluoride group, organic titanate coupling agents, aluminum-based coupling agents, silicone oils, and silicone varnishes.

As the external additives, a fine resin particle can be also added. Examples of the fine resin particle include polystyrenes obtained by soap-free emulsification polymerization, suspension polymerization, or dispersion polymerization; copolymers of a methacrylic ester or acrylic ester; particles produced by condensation polymerization of silicone, benzoguanamine, and nylon, etc.; and polymer particles produced using a thermosetting resin. By using such a fine resin particle in combination, it is possible to reinforce the chargeability of the toner, reduce the amount of reversely charged toner and to reduce the occurrence of background smear. The amount of the fine resin particle added to the toner is preferably 0.01% by mass to 5% by mass, and more preferably 0.1% by mass to 2% by mass.

—Additional Components—

The above-mentioned additional components are not particularly limited and may be appropriately selected depending on the pupose. For example, flowability improver, cleaning property improver, magnetic material, and metal soap are exemplified.

The flowability improver is used in performing a surface treatment to increase hydrophobicity of toner and is capable of preventing degradation of flowability property and charging property even under high-humidity conditions. Examples of the flowability improver include silane coupling agents, silylation agents, silane coupling agents having a fluoride alkyl group, organic titanate coupling agents, aluminum coupling agents, silicone oils, and modified silicone oils.

The cleaning property improver is added to the toner for removing a residual developer remaining on the latent electrostatic image bearing member and the intermediate transfer member after an image transfer. Examples thereof include aliphatic metal salts such as zinc stearate, calcium stearate, and stearic acid; and fine polymer particles produced by soap-free emulsification polymerization such as fine polymethyl methacrylate particle, and fine polystyrene particle. For the fine polymer particle, a particle having a relatively narrow particle size distribution is preferable, which has a volume average particle diameter of 0.01 μm to 1 μm.

The magnetic material is not particularly limited and may be appropriately selected from those known in the art depending on the purpose. For example, iron powder, magnetite, and ferrite are exemplified. Of these magnetic materials, white materials are preferable in terms of color tone.

<Method for Producing Toner>

The method for producing toner of the present invention may be selected from conventionally known toner production methods, such as kneading-pulverizing method, polymerization method, dissolution-suspension method, and spray granulation method. Of these, kneading-pulverizing method is preferable because it exerts the effects of the present invention in terms of productivity.

The pulverizing method is a method in which for example, toner materials containing at least a binder resin, a releasing agent, and a colorant is melted and kneaded, and the obtained kneaded product is pulverized and classified to thereby produce a toner base particle for the toner.

In the melting and kneading, the toner materials are mixed, and the mixture is placed in a melt-kneader to melt and knead the mixture. For the melt-kneader, for example, a uniaxial or biaxial continuous kneader or a batch type kneader with a roll mill can be used. For example, a KTK type biaxial extruder manufactured by Kobe Steel, Ltd., a TEM type extruder manufactured by Toshiba Machine Co., Ltd, a biaxial extruder manufactured by KCK, a PCM type biaxial extruder manufactured by Ikegai Co. Ltd., a Ko-kneader manufactured by Bus etc. are preferably used. The melting and kneading are preferably carried out under such appropriate conditions that do not cause cutting-off of molecular chains of the binder resin. Specifically, the melting and kneading temperature is selected in reference to the softening point of the binder resin. When the melting and kneading temperature is excessively higher than the softening point of the binder resin, molecular chains of the binder resin are severely broken, and when excessively lower than the softening point, the dispersion may not proceed.

In the pulverization, the kneaded product obtained in the kneading is pulverized. In this pulverization, it is preferable that first the kneaded product be coarsely crushed and then finely pulverized. In this process, the kneaded toner product is preferably pulverized by hitting the kneaded toner constituents against a collision board in a jet air stream or by colliding the particles with each other in a jet air stream, or by passing through a narrow gap between a rotor which mechanically revolves and a stator.

In the classification, the pulverized product obtained in the pulverization is classified to prepare particles having a predetermined particle diameter. The classification of toner particles can be performed by removing fine particles, for example, by a cyclone, a decanter, a centrifugal separator or the like.

After completion of the pulverization and the classification, the pulverized product is classified in an air stream using a centrifugal force, thereby producing a toner base particle having a predetermined particle diameter.

Next, an external additive is externally added to the toner base particle. By mixing and stirring the toner base particle and the external additive using a mixer, the toner base particle surface is coated with the external additive which is being pulverized. In this process, it is important, in terms of durability, to make an external additive such as fine inorganic particle and fine resin particle uniformly and solidly adhere on the surface of the toner base particles.

The weight average particle diameter of the toner is not particularly limited, and can be appropriately selected depending on the purpose. The weight average particle diameter of the toner can be determined as follows.

Measurement device: COULTER MULTISIZER II (manufactured by Beckman Coulter, Inc.)

Aperture diameter: 100 μm

Analyzer software: COULTER MULTISIZER ACCUCOMP Ver. 1.19 (manufactured by Beckman Coulter, Inc.)

Electrolyte: ISOTONE II (manufactured by Beckman Coulter, Inc.)

Dispersion liquid: 5% electrolytic solution of EMULGEN 109P (Polyoxyethylene lauryl ether, HLB: 13.6, manufactured by Kao Corporation)

Dispersion conditions: In 5 mL of the dispersion liquid, 10 mg of a measurement sample is added and dispersed using an ultrasonic dispersion device for one minute. Subsequently, 25 mL of the electrolyte is added thereto and further dispersed in the ultrasonic dispersion device for one minute.

Measurement conditions: in a beaker, 100 mL of the electrolyte and the resultant dispersion liquid are added, 30,000 particles are measured at a concentration where the particle diameter of 30,000 particles can be measured during 20 seconds, and the weight average particle diameter can be determined from the obtained particle diameter distribution.

(Developer)

The developer of the present invention contains at least the toner of the present invention and further contains appropriately selected additional components such as a carrier. The developer may be a one-component developer or may be a two-component developer, however, when the toner is to be used in an ultra high-speed print system, etc., which can be used in recent POD technology, it is preferable to use the two-component developer in terms of increasing lifetime.

The carrier is not particularly limited and may be appropriately selected depending on the purpose, however, the carrier preferably has a core material and a resin layer for coating the core material.

The material used as the core material is not particularly limited and may be appropriately selected from those known in the art. For example, 50 emu/g to 90 emu/g of manganese-strontium (Mn—Sr) materials and of manganese-magnesium (Mn—Mg) materials are preferable. In terms of ensuring high image density, ferromagnetic materials such as iron powder (100 emu/g or more), and magnetite (75 emu/g to 120 emu/g) are preferable. Further, in terms of capability of having a weak impact on a latent electrostatic image bearing member on which surface a toner is held vertically and the advantageousness of forming high-quality images, feebly magnetic materials such as copper-zinc (Cu—Zn) (30 emu/g to 80 emu/g) and the like are preferable. These materials may be used alone or in combination.

For the particle diameter of the core material, on the basis of the average particle diameter (weight average particle diameter ($D_{50}$)), it is preferably 10 μm to 200 μm, and more preferably 40 μm to 100 μm. When the average particle diameter (weight average particle diameter ($D_{50}$)) of the core material is smaller than 10 μm, in a carrier particle distribution, the amount of fine powder particles is increased, and the magnetization per one particle is reduced, which may cause carrier scattering. When the weight average particle diameter ($D_{50}$) is larger than 200 μm, the specific surface is reduced, which may cause toner scattering, and in a full-color image with a large portion of solid parts, the reproductivity of the solid parts particularly may possibly degrade.

The material used for the resin layer is not particularly limited and may be appropriately selected from known resins depending on the purpose. Examples thereof include amino resins, polyvinyl resins, polystyrene resins, halogenated olefin resins, polyester resins, polycarbonate resins, polyethylene resins, polyvinyl fluorides, polyvinylidene fluorides, polytrifluoroethylene resins, polyhexafluoropropylene resins, copolymers between vinylidene fluoride and acryl monomer, copolymers between vinylidene fluoride and vinyl fluoride, fluoroterpolymers (tri(multiple)fluoride copolymers) such as terpolymer of tetrafluoroethylene, vinylidene fluoride and nonfluorinated monomer, and silicone resins. These resins may be used alone or in combination. Of these, silicone resins are particularly preferable.

The silicone resin is not particularly limited and may be appropriately selected from generally known silicone resins depending on the purpose. Examples thereof include straight silicone resins composed of only organo-siloxane bond; and modified silicone resins which are modified with alkyd resin, polyester resin, epoxy resin, acrylic resin, urethane resin or the like.

The silicone resins are commercially available. Examples of the commercially available straight silicone resins include KR271, KR255, and KR152 manufactured by Shin-Etsu Chemical Co., Ltd.; and SR2400, SR2406, and SR2410 manufactured by Toray Daw Corning Silicone K.K.

Examples of the commercially available modified silicone resins include KR206 (alkyd-modified), KR5208 (acryl-modified), ES1001N (epoxy-modified), and KR305 (urethane-modified) manufactured by Shin-Etsu Chemical Co., Ltd.; and SR2115 (epoxy-modified), and SR2110 (alkyd-modified) manufactured by Toray Daw Corning Silicone K.K.

Note that each of these silicone resins can be used as a single substance, but it is also possible to use a cross-linkable component, a component capable of controlling charged amount and the like in combination.

The resin layer may contain a conductive powder as required. Examples of the conductive powder include metal powders, carbon black, titanium oxides, tin oxides, and zinc oxides. The average particle diameter of these conductive powders is preferably 1 μm or less. When the average particle diameter is larger than 1 μm, it may be difficult to control the electric resistance.

The resin layer can be formed, for example, by dissolving the silicone resin and the like in a solvent to prepare a coating solution, uniformly coating the surface of the core material with the coating solution by a known coating method, drying the core material surface, followed by baking the dried surface. For the coating method, for example, immersion method, spray method, and brush-coating method are exemplified.

The solvent is not particularly limited and may be appropriately selected depending on the purpose. Examples of the solvent include toluene, xylene, methylethylketone, methylisobutylketone, Cellosolve, and butylacetate.

The backing method is not particularly limited and may be external heating method or internal heating method. Examples thereof include a method using a fixed type electric furnace, a fluid type electric furnace, a rotary type electric furnace, a burner furnace or the like, or using a microwave.

The amount of the resin layer in the carrier is preferably 0.01% by mass to 5.0% by mass. When the amount of the resin layer is less than 0.01% by mass, the resin layer may not be uniformly formed on the surface of the core material, and when more than 5.0% by mass, granulation between carrier particles occurs due to the excessively thick resin layer, and it may be impossible to obtain a uniform carrier particle.

When the developer is a two-component developer, the amount of the carrier in the two-component developer is not particularly limited and may be appropriately selected depending on the purpose. For example, it is preferably 90% by mass to 98% by mass, and more preferably 93% by mass to 97% by mass.

For the mixture ratio between a toner and a carrier in the two-component developer, generally preferably, a toner is mixed in an amount of 1 part by mass to 10.0 parts by mass relative to 100 parts by mass of a carrier.

The toner and the developer of the present invention may achieve both low-temperature fixing property, anti-offset property, and heat-resistance storage stability at such a level that they can be used in an ultra high-speed fixing system, can achieve a low friction coefficient of images, especially fixed images, formed by various electrophotographic methods (reduction in μ of fixed images), and can achieve excellent productivity, therefore the toner and the developer of the present invention are suitable for an ultra high-speed print system which can be used in print on demand (POD) technology using an electrophotographic method.

EXAMPLES

Hereinafter, the Examples of the present invention will be described, however, the present invention is not limited to these Examples.

The characteristic values of the polyester resins and the weight average particle diameters of the toners in the following Examples and Comparative Examples are measured as follows.

<Softening Point of Polyester Resin>

Using FLOWTESTER (CFT-500D, manufactured by Shimazu Corporation), 1 g of a sample was heated at a temperature increase rate of 6° C./min under application of a load of 1.96 MPa by means of a plunger to push it out of a nozzle having a diameter of 1 mm and a length of 1 mm, and the fall amount of the plunger in the FLOWTESTER with respect to temperature was plotted. The temperature at which one-half of the sample flowed out was defined as the softening point of the resin sample.

<Glass Transition Temperature of Polyester Resin>

Using a differential scanning calorimeter (DSC210, manufactured by Seiko Instruments Inc.), a weighed sample (0.01 g to 0.02 g) was put on an aluminum pan, the temperature of the sample was increased to 200° C., and then cooled at a temperature decreasing rate of 10° C./min from 200° C. to 0° C. When the temperature of the cooled sample was increased again at a temperature increasing rate of 10° C./min, a temperature at an intersection point between an extended line of the base line of temperatures lower than the temperature of maximum endothermic peak and a tangent line showing the maximum inclination from the start-up point of the peak to the peak top was determined and defined as the glass transition temperature of the sample.

<Acid Value of Polyester Resin>

The acid value of polyester resin was measured according to the method described in JIS K0070. However, for only the solvent used in the measurement, a mixture solvent of acetone and toluene (acetone:toluene=1.1 (volume ratio)) was used instead of the mixture solvent of ethanol and ether defined in the JIS K0070.

<Weight Average Particle Diameter of Toner>

Measurement device: COULTER MULTISIZER II (manufactured by Beckman Coulter, Inc.)

Aperture diameter: 100

Range of particle diameter measured: 2 μm to 60 μm

Analyzer software: COULTER MULTISIZER ACCU-COMP Ver. 1.19 (manufactured by Beckman Coulter, Inc.)

Electrolyte: ISOTONE II (manufactured by Beckman Coulter, Inc.)

Dispersion liquid: 5% electrolytic solution of EMULGEN 109P (Polyoxyethylene lauryl ether, HLB: 13.6, manufactured by Kao Corporation)

Dispersion conditions: In 5 mL of the dispersion liquid, 10 mg of a measurement sample is added and dispersed using an ultrasonic dispersion device for one minute. Subsequently, 25 mL of the electrolyte is added thereto and further dispersed in the ultrasonic dispersion device for one minute.

Measurement conditions: in a beaker, 100 mL of the electrolyte and the resultant dispersion liquid are added, 30,000 particles are measured at a concentration where the particle diameter of 30,000 particles can be measured during 20 seconds, and the weight average particle diameter can be determined from the obtained particle diameter distribution.

Synthesis Example 1

Synthesis of Polyester Resins A1 to A6, B4, and C1 to C6

An alcohol component, carboxylic acid component other than trimellitic anhydride, and esterification catalyst shown in Tables 1 to 3 were poured into a 5 L four-necked flask equipped with a nitrogen inlet tube, a dewatering tube, a stirrer, and a thermocouple, and the components were subjected to a condensation polymerization reaction under a nitrogen atmosphere at 230° C. for 10 hours and then further reacted at 230° C. under a pressure of 8 kPa for 1 hour. After the reactant was cooled to 220° C., trimellitic anhydride shown in Tables 1 to 3 was added thereto, and the mixture was reacted at a normal pressure (101.3 kPa) for 1 hour, and further reacted at 220° C. at 20 kPa until the products each showed a desired softening point to prepare the polyester resins A1 to A6, the polyester resin B4, and the polyester resins C1 to C6. The softening point, glass transition temperature, and acid value of each resins are shown in the Tables 1 to 3.

Synthesis Example 2

Synthesis of Polyester Resins B1 to B3, and B5 and B6

An alcohol component, carboxylic acid component other than trimellitic anhydride, and esterification catalyst shown in Tables 2 were poured into a 5 L four-necked flask equipped with a nitrogen inlet tube, a dewatering tube, a stirrer, and a thermocouple, and the components were subjected to a condensation polymerization reaction under a nitrogen atmosphere at 230° C. for 10 hours and then further reacted at 230° C. under a pressure of 8 kPa for 1 hour. After the reactant was cooled to 220° C., the reactant was then reacted at 220° C. at 20 kPa until the products each showed a desired softening point to prepare the polyester resins B1 to B3, and the polyester resins B5 and B6. The softening point, glass transition temperature, and acid value of each resins are shown in the Table 2.

TABLE 1

| | | Resin A1 | Resin A2 | Resin A3 | Resin A4 | Resin A5 | Resin A6 |
|---|---|---|---|---|---|---|---|
| Alcohol component | 1,3-propanediol | 399 g | 399 g | 799 g | — | 399 g | 399 g |
| | 1,2-propanediol | 742 g | 742 g | 342 g | 1,141 g | 742 g | 742 g |
| Carboxylic acid component | terephthalic acid | 1,944 g | 2,118 g | 2,118 g | 2,068 g | 2,118 g | 1,994 g |
| | itaconic acid | 351 g | 195 g | 137 g | 234 g | 195 g | 351 g |
| | trimellitic anhydride | 58 g | 144 g | 231 g | 144 g | 144 g | 58 g |
| Esterification catalyst | tin (II) 2-ethylhexanoate | 18 g | 18 g | 18 g | 18 g | 18 g | 18 g |
| Amount of 1,2-propanediol in alcohol component (mole %) | | 65 | 65 | 30 | 100 | 65 | 65 |
| Properties of Resins | Softening point (° C.) | 120.6 | 152.0 | 151.7 | 147.8 | 153.1 | 118.3 |
| | Grass transition temperature (° C.) | 56.2 | 61.8 | 63.4 | 60.8 | 62.1 | 56.0 |
| | Acid value (mgKOH/g) | 20.8 | 18.7 | 18.6 | 21.3 | 33.4 | 20.8 |

TABLE 2

| | | Resin B1 | Resin B2 | Resin B3 | Resin B4 | Resin B5 | Resin B6 |
|---|---|---|---|---|---|---|---|
| Alcohol component | 1,3-propanediol | 399 g | 799 g | — | 399 g | 399 g | 399 g |
| | 1,2-propanediol | 742 g | 342 g | 1,141 g | 742 g | 742 g | 742 g |
| Carhoxylic acid component | terephthalic acid | 1,744 g | 1,744 g | 1,744 g | 1,695 g | 1,869 g | 1,246 g |
| | itaconic acid | 293 g | 293 g | 293 g | 293 g | 195 g | 683 g |
| | trimellitic anhydride | — | — | — | 58 g | — | — |
| Esterification catalyst | tin (II) 2-ethylhexanoate | 16 g | 16 g | 16 g | 16 g | 16 g | 15 g |
| Amount of 1,2-propanediol in alcohol component (mole %) | | 65 | 30 | 100 | 65 | 65 | 65 |
| Properties of Resins | Softening point (° C.) | 110.0 | 110.6 | 108.7 | 110.4 | 121.6 | 79.5 |
| | Grass transition temperature (° C.) | 58.8 | 56.9 | 59.0 | 60.2 | 61.0 | 53.5 |
| | Acid value (mgKOH/g) | 15.6 | 16.2 | 18.9 | 26.0 | 15.7 | 16.3 |

TABLE 3

| | | Resin C1 | Resin C2 | Resin C3 | Resin C4 | Resin C5 | Resin C6 |
|---|---|---|---|---|---|---|---|
| Alcohol component | BPA-PO* | 517 g | 517 g | 258 g | 517 g | — | 517 g |
| | BPF-PO* | — | — | — | — | 380 g | — |
| | 1,2-propanediol | — | — | 57 g | — | 23 g | — |
| Carboxylic acid component | terephthalic acid | 125 g | 125 g | 150 g | 125 g | 125 g | 125 g |
| | itaconic acid | 78 g | 78 g | 39 g | 78 g | 78 g | 78 g |
| | trimellitic anhydride | 144 g | 144 | 173 g | 144 g | 144 g | 144 g |
| Esterification catalyst | tin (II) 2-ethylhexanoate | 4 g | 4 g | 3 g | 4 g | 4 g | 4 g |
| Amount of bisphenol compound in alcohol component (mole %) | | 100 | 100 | 50 | 100 | 80 | 100 |
| Properties of Resins | Softening point (° C.) | 112 | 103.8 | 111.7 | 121.2 | 80.3 | 118.5 |
| | Grass transition temperature (° C.) | 60.6 | 58.9 | 60.3 | 61.7 | 57.2 | 61.5 |
| | Acid value (mgKOH/g) | 10.4 | 8.1 | 13.3 | 12.7 | 5.6 | 12.0 |

*BPA-PO: a propylene oxide adduct of bisphenol A, polyoxypropylene (2,2)-2,2-bis (4-hydroxyphenyl) propane

*BPF-PO: a propylene oxide adduct of bisphenol F, polyoxypropylene (2,2)-2,2-bis (4-hydroxyphenyl) methane Production of Toner For each toner, binder resins, a releasing agent, and a colorant whose types and amounts are specified in Table 4 were premixed using a HENSCHEL MIXER (FM10B, manufactured by Mitsui Miike Chemical Machine Co., Ltd.), and then the premix was fused and kneaded at a temperature ranging from 100° C. to 130° C. using a biaxial kneader (PCM-30, manufactured by IKEGAI Co., Ltd.). The thus obtained kneaded product was cooled to room temperature and then coarsely crushed into granules of 200 μm to 300 μm in size using a hammer mill. Subsequently, the granules were pulverized so as to have a weight average particle diameter of 8.2 μm±0.3 μm while appropriately controlling the pulverization air pressure using an ultrasonic jet pulverizer, LABO-JET (manufactured by Nippon Pneumatic Mfg. Co., Ltd.) and then classified using an airflow classifier (MDS-I, manufactured by Nippon Pneumatic Mfg. Co., Ltd.) while appropriately controlling the louver opening such that toner particles had a weight average particle diameter of 9.0 μm±0.2 μm and the amount of fine particles having a weight average particle diameter of 4 μm or less was 10% by number or less, thereby obtaining a toner base particle. Next, 1.0 part by mass of an additive (HDK-2000, manufactured by Clariant Japan K.K.) was stirred and mixed with 100 parts by mass of the toner base particle in a HENSCHEL MIXER, thereby producing each of toners 1 to 18.

TABLE 4

| | Binder resin | | | | | | | | | |
|---|---|---|---|---|---|---|---|---|---|---|
| | Polyester resin (A) | | Polyester resin (B) | | Polyester resin (C) | | Releasing agent | | Colorant | |
| Toner 1 | Resin A1 | 20 parts | Resin B1 | 30 parts | Resin C1 | 50 parts | Carnauba wax | 5 parts | Carbon black | 8 parts |
| Toner 2 | Resin A2 | 20 parts | Resin B1 | 30 parts | Resin C1 | 50 parts | Carnauba wax | 5 parts | Carbon black | 8 parts |
| Toner 3 | Resin A2 | 20 parts | Resin B2 | 30 parts | Resin C1 | 50 parts | Carnauba wax | 5 parts | Carbon black | 8 parts |
| Toner 4 | Resin A3 | 20 parts | Resin B1 | 30 parts | Resin C1 | 50 parts | Carnauba wax | 5 parts | Carbon black | 8 parts |
| Toner 5 | Resin A4 | 20 parts | Resin B3 | 30 parts | Resin C2 | 50 parts | Carnauba wax | 5 parts | Carbon black | 8 parts |
| Toner 6 | Resin A2 | 16 parts | Resin B1 | 24 parts | Resin C1 | 60 parts | Carnauba wax | 5 parts | Carbon black | 8 parts |
| Toner 7 | Resin A2 | 8 parts | Resin B1 | 12 parts | Resin C1 | 80 parts | Carnauba wax | 5 parts | Carbon black | 8 parts |
| Toner 8 | Resin A2 | 20 parts | Resin B1 | 30 parts | Resin C3 | 50 parts | Carnauba wax | 5 parts | Carbon black | 8 parts |
| Toner 9 | Resin A5 | 20 parts | Resin B4 | 30 parts | Resin C1 | 50 parts | Carnauba wax | 5 parts | Carbon black | 8 parts |
| Toner 10 | Resin A2 | 20 parts | Resin B5 | 30 parts | Resin C4 | 50 parts | Carnauba wax | 5 parts | Carbon black | 8 parts |
| Toner 11 | Resin A2 | 20 parts | Resin B6 | 30 parts | Resin C5 | 50 parts | Carnauba wax | 5 parts | Carbon black | 8 parts |
| Toner 12 | Resin A2 | 20 parts | Resin B1 | 30 parts | Resin C1 | 50 parts | Paraffin wax | 5 parts | Carbon black | 8 parts |
| Toner 13 | Resin A3 | 20 parts | Resin B2 | 30 parts | Resin C1 | 50 parts | Carnauba wax | 5 parts | Carbon black | 8 parts |
| Toner 14 | Resin A6 | 20 parts | Resin B1 | 30 parts | Resin C1 | 50 parts | Carnauba wax | 5 parts | Carbon black | 8 parts |
| Toner 15 | Resin A2 | 20 parts | Resin B1 | 30 parts | Resin C6 | 50 parts | Carnauba wax | 5 parts | Carbon black | 8 parts |
| Toner 16 | Resin A2 | 20 parts | Resin B1 | 30 parts | Resin C2 | 50 parts | Carnauba wax | 5 parts | Carbon black | 8 parts |
| Toner 17 | Resin A2 | 20 parts | Resin B1 | 30 parts | — | — | Carnauba wax | 5 parts | Carbon black | 8 parts |
| Toner 18 | Resin A2 | 50 parts | — | — | Resin C1 | 50 parts | Carnauba wax | 5 parts | Carbon black | 8 parts |

* "parts" means "parts by mass".

* For releasing agents, a paraffin wax (HNP-9PD, manufactured by Nippon Seiro Co., Ltd.; melting point: 76.1° C.) and a free fatty acid-removed type carnauba wax (WA-03, manufactured by TOA KASEI CO., LTD.; melting point: 82.8° C.) were used.

Examples 1 to 12 and Comparative Examples 1 to 6

Next, the softening points Tm(A), Tm(B), and Tm(C) for the polyester resin (A), the polyester resin (B), and the polyester resin (C), respectively, which were used in each toner obtained, a difference Tm(A−B) of the softening point Tm(A) and the softening point Tm(B), an absolute difference |Tm(B−C)| of the softening point Tm(B) and the softening point Tm(C), and mass ratios (A/B) and [C/(A+B)] of the polyester resins are shown in Table 5.

—Production of Carrier—

A coating material with the following composition was dispersed using a stirrer for 10 minutes to prepare a coating solution, and the coating solution and 5,000 parts by mass of a core material (Cu—Zn ferrite particle, mass average particle diameter=80 μm) were put into a coating device equipped with a rotatable bottom plate disc and a stirring blades in a fluidized bed to perform coating while forming swirling flow, whereby the coating solution was applied over the surface of the core material. Thus obtained coated material was calcined in an electric furnace at 280° C. for 2 hours, thereby producing a carrier.

[Composition of Coating Material]

toluene . . . 450 parts by mass silicone resin (SR2400, manufactured by Toray Daw Corning Silicone K.K.; non-volatile matter: 50% by mass) . . . 450 parts by mass aminosilane (SH6020, manufactured by Toray Daw Corning Silicone K.K.) . . . 10 parts by mass carbon black 10 parts by mass —Production of Two-Component Developer—

In a tabular mixer of the type which stirs contents therein by the rolling of the container itself (manufactured by Willy A Bachofen (WAB) AG), 5% by mass of each of the produced toners 1 to 18 was mixed with 95% by mass of the thus produced carrier uniformly for 5 minutes at 48 rpm to charge the toner, thereby producing each of the two-component developers 1 to 18.

TABLE 5

| | Toner | Developer | Polyester resin (A) Tm(A) (° C.) | Amount of 1,2-propnanediol in alcohol component (mol %) | Acid value (mgKOH/g) | Polyester resin (B) Tm(B) (° C.) | Amount of 1,2-propnanediol in alcohol component (mol %) | Acid value (mgKOH/g) |
|---|---|---|---|---|---|---|---|---|
| Ex. 1 | Toner 1 | Developer 1 | 120.6 | 65 | 20.8 | 110.0 | 65 | 15.6 |
| Ex. 2 | Toner 2 | Developer 2 | 152.0 | 65 | 18.7 | 110.0 | 65 | 15.6 |
| Ex. 3 | Toner 3 | Developer 3 | 152.0 | 65 | 18.7 | 110.6 | 30 | 16.2 |
| Ex. 4 | Toner 4 | Developer 4 | 151.7 | 30 | 18.6 | 110.0 | 65 | 15.6 |
| Ex. 5 | Toner 5 | Developer 5 | 147.8 | 100 | 21.3 | 108.7 | 100 | 18.9 |
| Ex. 6 | Toner 6 | Developer 6 | 152.0 | 65 | 18.7 | 110.0 | 65 | 15.6 |
| Ex. 7 | Toner 7 | Developer 7 | 152.0 | 65 | 18.7 | 110.0 | 65 | 15.6 |
| Ex. 8 | Toner 8 | Developer 8 | 152.0 | 65 | 18.7 | 110.0 | 65 | 15.6 |
| Ex. 9 | Toner 9 | Developer 9 | 153.1 | 65 | 33.4 | 110.4 | 65 | 26.0 |
| Ex. 10 | Toner 10 | Developer 10 | 152.0 | 65 | 18.7 | 121.6 | 65 | 15.7 |
| Ex. 11 | Toner 11 | Developer 11 | 152.0 | 65 | 18.7 | 79.5 | 65 | 16.3 |
| Ex. 12 | Toner 12 | Developer 12 | 152.0 | 65 | 18.7 | 110.0 | 65 | 15.6 |
| Compar. Ex. 1 | Toner 13 | Developer 13 | 151.7 | 30 | 18.6 | 110.6 | 30 | 16.2 |
| Compar. Ex. 2 | Toner 14 | Developer 14 | 118.3 | 65 | 20.8 | 110.0 | 65 | 15.6 |
| Compar. Ex. 3 | Toner 15 | Developer 15 | 152.0 | 65 | 18.7 | 110.0 | 65 | 15.6 |
| Compar. Ex. 4 | Toner 16 | Developer 16 | 152.0 | 65 | 18.7 | 110.0 | 65 | 15.6 |
| Compar. Ex. 5 | Toner 17 | Developer 17 | 152.0 | 65 | 18.7 | 110.0 | 65 | 15.6 |
| Compar. Ex. 6 | Toner 18 | Developer 18 | 152.0 | 65 | 18.7 | — | — | — |

| | Polyester resin (C) Tm(C) (° C.) | Amount of 1,2-propnanediol in alcohol component (mol %) | Acid value (mgKOH/g) | Tm(A − B) (° C.) | \| Tm(B − C) \| (° C.) | A/B | C/(A + B) |
|---|---|---|---|---|---|---|---|
| Ex. 1 | 112.0 | 100 | 10.4 | 10.6 | 2.0 | 4/6 | 5/5 |
| Ex. 2 | 112.0 | 100 | 10.4 | 42.0 | 2.0 | 4/6 | 5/5 |
| Ex. 3 | 112.0 | 100 | 10.4 | 41.4 | 1.4 | 4/6 | 5/5 |
| Ex. 4 | 112.0 | 100 | 10.4 | 41.7 | 2.0 | 4/6 | 5/5 |
| Ex. 5 | 103.8 | 100 | 8.1 | 39.1 | 4.9 | 4/6 | 5/5 |
| Ex. 6 | 112.0 | 100 | 10.4 | 42.0 | 2.0 | 4/6 | 6/4 |
| Ex. 7 | 112.0 | 100 | 10.4 | 42.0 | 2.0 | 4/6 | 8/2 |
| Ex. 8 | 111.7 | 50 | 13.3 | 42.0 | 1.7 | 4/6 | 5/5 |
| Ex. 9 | 112.0 | 100 | 10.4 | 42.7 | 1.6 | 4/6 | 5/5 |
| Ex. 10 | 121.2 | 100 | 12.7 | 30.4 | 0.4 | 4/6 | 5/5 |
| Ex. 11 | 84.2 | 80 | 5.6 | 72.5 | 4.7 | 4/6 | 5/5 |
| Ex. 12 | 112.0 | 100 | 10.4 | 42.0 | 2.0 | 4/6 | 5/5 |
| Compar. Ex. 1 | 112.0 | 100 | 10.4 | 41.1 | 1.4 | 4/6 | 5/5 |
| Compar. Ex. 2 | 112.0 | 100 | 10.4 | 8.3 | 2.0 | 4/6 | 5/5 |
| Compar. Ex. 3 | 118.5 | 100 | 12.0 | 42.0 | 8.5 | 4/6 | 5/5 |
| Compar. Ex. 4 | 103.8 | 100 | 8.1 | 42.0 | 6.2 | 4/6 | 5/5 |
| Compar. Ex. 5 | — | — | — | 42.0 | — | 4/6 | 0/10 |
| Compar. Ex. 6 | 112.0 | 100 | 10.4 | — | — | 10/0 | 5/5 |

—Evaluation of Performance—

Next, toners 1 to 18 of Examples and Comparative Examples were evaluated as to pulverizability, smear resistance, the friction coefficient of surface of fixed image, anti-cold offset property, anti-hot offset property, and heat resistance-storage stability. The results are exhibited in Table 6.

Note that the smear resistance, anti-cold offset property, and anti-hot offset property of each of the developers 1 to 18 of the Examples and Comparative Examples were evaluated by supplying and using them in an image forming apparatus.

For the image forming apparatus, an ultra high-speed digital laser printer (IPSIO SP9500PRO, manufactured by Ricoh Company, Ltd.; print speed: 156 paper sheets ("A4" paper sheet fed into the printer's printing part from its longer side)/min) using a two-component system, a direct transfer method, and a heating roller fixation method was used.

<Pulverizability>

The fused and kneaded product of raw material obtained in the production of each of toners in Examples and Comparative Examples was coarsely crushed into granules by a hammer mill so as to have a particle diameter of 200 μm to 300 μm, 10.00 g of the coarse granules was precisely weighed and pulverized for 30 seconds using a mill-mixer, model MM-I (available from Hitachi Living Systems), and then sieved through a 30 mesh screen (opening: 500 μm). The mass (A) of the unpassed resins (grams) was precisely weighed, and a residual rate was determined based on the following Equation (i). This process was repeated three times, and the average value of obtained average residual rates was used as an indicator to thereby evaluate the pulverizability of each of the toners according to the following evaluation criteria. Smaller average value of average residual rates is more preferable from the viewpoint of pulverizability.

$$\text{Residual rate (\%)}=[(A)/\text{mass of unpulverized toner (10.00 g)}]\times 100 \quad \text{[Equation (i)]}$$

[Evaluation Criteria]

A: The residual rate was less than 3%.

B: The residual rate was 3% or more and less than 8%.

C: The residual rate was 8% or more and less than 15% (conventional toners are ranked in this category).

D: The residual rate was 15% or more and less than 20%.

E: The residual rate was 20% or more.

<Heat Resistance-Storage Stability>

The heat resistance-storage stability of each of the toners was measured using a penetration tester (manufactured by Nikka Engineering Co., Ltd.). Specifically, 10 g of each of the toners was weighed and put into a 30 mL glass vial (screw vial) under the conditions of a temperature of 20° C. to 25° C. and a relative humidity (RH) of 40% to 60%, and the vial was closed with a lid.

The glass vial with the toner contained therein was tapped 200 times and then left intact in a thermostatic bath whose temperature was held at 50° C. for 48 hours, the penetration rate of the toner was measured using the penetration tester, and the heat resistance-storage stability of the toner was evaluated based on the following evaluation criteria. Higher penetration rate is more preferable from the viewpoint of heat resistance-storage stability.

[Evaluation Criteria]

A: The penetration rate was 30 mm or more.

B: The penetration rate was 20 mm to 29 mm.

C: The penetration rate was 15 mm to 19 mm (conventional toners are ranked in this category).

D: The penetration rate was 8 mm to 14 mm.

E: The penetration rate was 7 mm or less.

<Anti-Cold Offset Property>

An ultra high-speed digital laser printer (IPSIO SP9500PRO) was charged with each of the developers, then a solid image in a 1-cm-square shape with a toner adhesion amount of 0.20 mg/cm$^2$±0.1 mg/cm$^2$ was formed on an image transfer sheet of heavy paper (copy print paper <135>, manufactured by NBS Ricoh Company Ltd.), and a fixing test was carried out. In the fixing test, the solid image was sealed with SCOTCH Mending tape 810 (width: 24 mm, manufactured by Sumitomo 3M Limited), and the solid image was rolled under a metal roller weighing 1 kg (diameter: 50 mm, manufactured by SUS Corporation) over the tape at a rolling speed of 10 mm/s for 10 back-and forth movements of the roller. The tape was peeled off the solid image in a constant direction at a peeling speed of 10 mm/s, image densities before and after the tape peeling were measured for calculation of the image retaining rate using the following Equation (ii), and thereby anti-cold offset property of each of the developers was assessed according to the following Evaluation Criteria.

$$\text{Image retaining rate (\%)}=[\text{image density after peeling}/\text{image density before peeling}]\times 100 \quad \text{[Equation (ii)]}$$

[Evaluation Criteria]

A: The image remaining rate was 97% or more.

B: The image remaining rate was 92% or more and less than 97%.

C: The image remaining rate was 85% or more and less than 92%.

D: The image remaining rate was 80% or more and less than 85% (conventional toners are ranked in this category).

E: The image retamaining rate was less than 80%.

<Anti-Hot Offset Property>

An ultra high-speed digital laser printer (IPSIO SP9500PRO) was charged with each of the developers, then a solid image in a 1-cm-square shape with a toner adhesion amount of 0.40 mg/cm$^2$±0.1 mg/cm$^2$ was formed on an image transfer sheet of thin paper (copy print paper <55>, manufactured by NBS Ricoh Company Ltd.), and the image was fixed with varying the temperature of the fixing belt. The presence or absence of hot offset was visually checked and evaluated, and the highest temperature at which no hot-offset was caused was regarded as the image fixing upper limit temperature, and anti-hot offset property of each of the toners was evaluated based on the following criteria.

[Evaluation Criteria]

A: The image fixing upper limit temperature was 240° C. or more.

B: The image fixing upper limit temperature was 220° C. or more and less than 240° C.

C: The image fixing upper limit temperature was 200° C. or more and less than 220° C.

D: The image fixing upper limit temperature was 180° C. or more and less than 200° C. (conventional toners are ranked in this category).

E: The image fixing upper limit temperature was less than 180° C.

<Smear Resistance>

An ultra high-speed digital laser printer (IPSIO SP9500PRO) was charged with each of the developers, an image of letters as shown in FIG. 1 was printed on a sheet of recycled paper (recycled paper, manufactured by NBS Ricoh Company Ltd., resource type: A, and smoothness: 34 s), and the image of letters printed was rubbed 50 times by the recycled paper using an S type friction tester (SUTHERLAND2000 RUB TESTER, manufactured by Danilee Co.) with a load of 800 g, thereby evaluating smear resistance of each of the developers by ranking smear degree of the image according to the following criteria.

Note that the above-mentioned smoothness represents an indicator of surface property of paper, and the smoothness of the paper called as regular paper usually takes a value more than 40 s and about 150 s or less. When paper of a rough surface, such as paper having a smoothness of 40 s or less, is used, the fixing property of the resulting image may easily become inadequate. Smoothness is measured in accordance with JIS P8119 (paper and paper board—smoothness testing method by means of Bekk smoothness tester).

[Evaluation Criteria]

A: The image had no detectable smear.

B: The image had smear almost visually undetectable.

C: The image had smear visually detectable but causing no problem.

D: The image had smear obviously causing problems (conventional toners are ranked in this category).

E: The image had smear obviously causing problems and making use of the image difficult.

Figure 2:
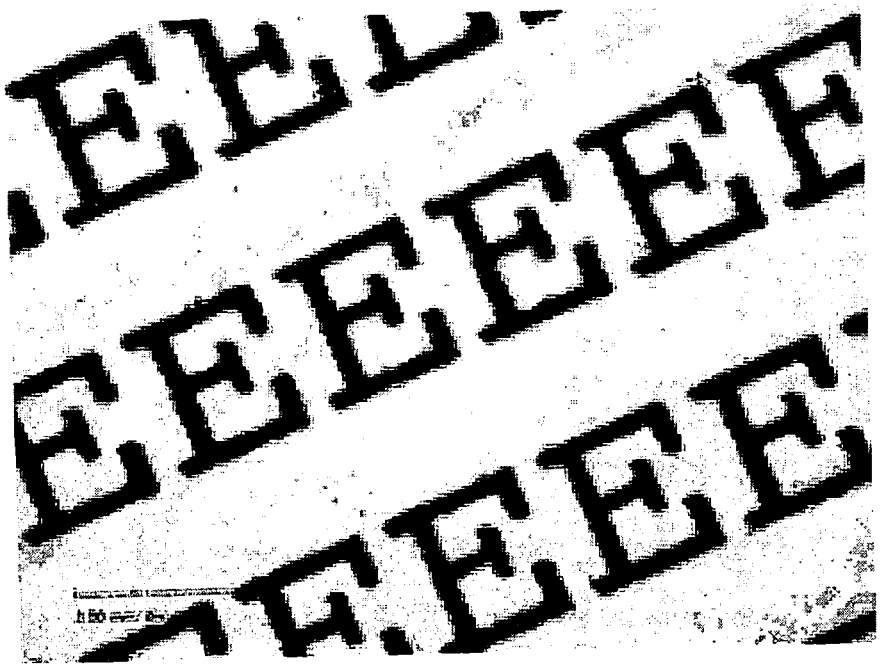
FIG. 2 is a photograph of an image which was formed with a toner of Example 3 and evaluated as having almost visually undetectable smear (B) after rubbing in evaluation criteria for smear resistance.
Figure 3:
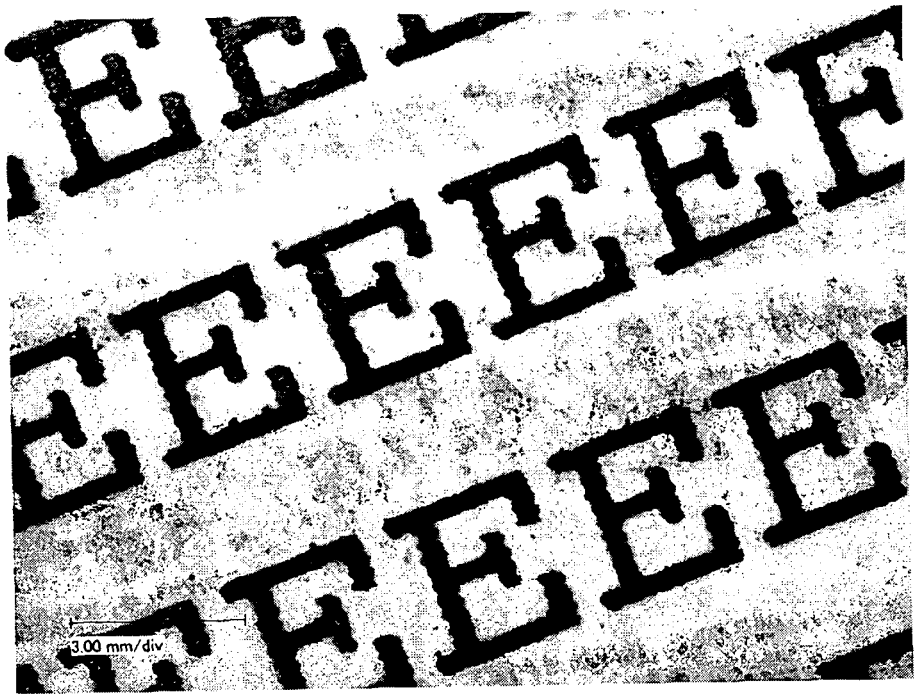
FIG. 3 is a photograph exhibiting an image which was formed with a toner of Comparative Example 1 and evaluated as having smear obviously causing problems (D) after rubbing according to evaluation criteria for smear resistance.

As reference, images after rubbing were exhibited in FIGS. 1 to 3. FIG. 1 is an image which was formed with a toner of Example 1 and evaluated as having no smear (A) after rubbing. FIG. 2 is an image which was formed with a toner of Example 3 and evaluated as having almost visually undetectable smear (B) after rubbing. FIG. 3 is an image which was formed with a toner of Comparative Example 1 and evaluated as having smear obviously causing problems (D) after rubbing.

<Friction Coefficient of Surface of Fixed Image>

An ultra high-speed digital laser printer (IPSIO SP9500PRO) was charged with each of the developers, then a solid image in a 2-cm-square shape with a toner adhesion amount of 0.80 mg/cm$^2$±0.1 mg/cm$^2$ was formed on an image transfer sheet of thin paper (copy print paper <70>, manufactured by NBS Ricoh Company Ltd.), thereby measuring the friction coefficient of surface of the fixed image. The smaller the friction coefficient of the surface is, the more excellent the smear resistance is. The friction coefficient of the surface was measured using a full automatic friction abrasion analyzer (DF PM-SS type, manufactured by Kyowa Interface Science Co., LTD), and evaluated according to the following evaluation criteria. All the friction coefficients were fully automatically measured by means of the analyzer, using as a terminal a stainless ball which has a standard diameter of 3 mm and is associated with the device.

TABLE 6

| | Pulverizability | Friction coefficient of fixed image | Smear resistance | Anti-cold offset property | Anti-hot offset property | Heat-resistance storage stability |
|---|---|---|---|---|---|---|
| Ex. 1 | B | 0.17 | A | A | C | B |
| Ex. 2 | B | 0.25 | A | A | B | A |
| Ex. 3 | B | 0.30 | B | A | B | A |
| Ex. 4 | B | 0.31 | B | A | B | A |
| Ex. 5 | A | 0.18 | A | B | A | A |
| Ex. 6 | B | 0.27 | A | B | A | A |
| Ex. 7 | B | 0.33 | B | C | A | A |
| Ex. 8 | B | 0.31 | B | B | B | A |
| Ex. 9 | B | 0.10 | A | A | B | A |
| Ex. 10 | B | 0.26 | A | C | B | A |
| Ex. 11 | B | 0.26 | A | A | C | B |
| Ex. 12 | B | 0.15 | A | A | B | A |
| Compar. Ex. 1 | C | 0.45 | D | A | C | C |
| Compar. Ex. 2 | B | 0.26 | A | A | E | D |
| Compar. Ex. 3 | B | 0.60 | E | B | B | A |
| Compar. Ex. 4 | B | 0.53 | E | A | D | C |
| Compar. Ex. 5 | A | 0.64 | E | A | C | C |
| Compar. Ex. 6 | C | 0.44 | D | E | B | A |

It was seen from the results in Tables 5 and 6 that the Examples 1 to 12 were more excellent than the Comparative Examples 1 to 6 in that they achieved both low-temperature fixing ability, anti-offset property, and heat-resistance storage property at such a level that they can be used in an ultra high-speed image forming system, as well as achieved particularly noteworthy effects on smear resistance by reducing μ of the fixed images and achieved excellent productivity.

Industrial Applicability

Since a toner and a developer of the present invention achieve both low-temperature fixing property, anti-offset property, and heat-resistance storage stability at such a level that they can be used in an ultra high-speed fixing system, and particularly achieve a low friction coefficient of fixed images (reduction of μ of fixed images) and excellent productivity, they are suitable, for example, for use in an ultra high-speed print system which can be used in print on demand technology using an electrophotographic method.

The invention claimed is:

1. A toner comprising:

(I) a binder resin, (II) a releasing agent, and (III) a colorant, wherein the binder resin (I) comprises polyester resin (A), polyester resin (B), and polyester resin (C), which is prepared by condensation-polymerizing (i) an alcohol component comprising an alkylene oxide adduct of a bisphenol compound represented by formula (1)

General formula (1)

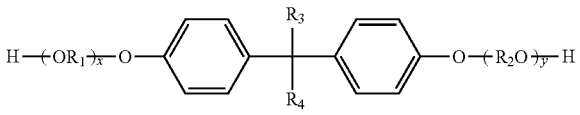

wherein $R_1$ and $R_2$ each represent a $C_2$-$C_4$ alkylene group;

$R_3$ and $R_4$ are selected from the group consisting of hydrogen atom, a $C_1$-$C_6$ straight-chain alkyl group, and a $C_1$-$C_6$ branched-chain alkyl group;

x and y each represent a positive integer and the sum of x and y is 1 to 16, and (ii) a carboxylic acid component;

wherein at least one of the polyester resin (A) and the polyester resin (B) is a polyester resin prepared by condensation-polymerizing (i) the alcohol component comprising at least one aliphatic alcohol and comprising 1,2-propanediol in an amount of 65 mole % or more of a divalent alcohol component and (ii) the carboxylic acid component; and wherein a softening point Tm(A) of the polyester resin (A) is 10° C. or more higher than a softening point Tm(B) of the polyester resin (B), and an absolute difference between a softening point Tm(C) of the polyester resin (C) and the softening point Tm(B) of the polyester resin (B) is 5° C. or less.

2. The toner according to claim 1, wherein both of the polyester resin (A) and the polyester resin (B) are polyester resins prepared by condensationpolymerizing (i) an alcohol component comprising only aliphatic alcohol and comprising 1,2-propanediol in an amount of 65 mole % or more of a divalent alcohol component and (ii) a carboxylic acid component.

3. The toner of claim 1, wherein a mass ratio [(C)/((A)+(B))] of the polyester resin (C) to the polyester resin (A) and the polyester resin (B) is 1/9 to 6/4.

4. The toner of claim 1, wherein a mass ratio [(A)/(B)] of the polyester resin (A) to the polyester resin (B) is 1/9 to 9/1.

5. The toner of claim 1, wherein the alcohol component of at least one of the polyester resin (A) and the polyester resin (B) further comprises 1,3-propanediol.

6. The toner of claim 1, wherein the carboxylic acid component of at least one of the polyester resin (A) and the polyester resin (B) comprises a $C_2$-$C_5$ aliphatic dicarboxylic acid compound.

7. The toner of claim 1, wherein the polyester resin (C) is prepared by condensation-polymerizing (i) the alcohol component comprising the alkylene oxide adduct of a bisphenol compound represented by formula (1), in an amount of 80 mole % or more of the divalent alcohol component, and (ii) the carboxylic acid component.

8. The toner of claim 1, wherein the softening point Tm(B) of the polyester resin (B) is 80° C. or more and less than 120° C.

9. The toner of claim 1, wherein the at least one of the polyester resin (A) and the polyester resin (B) has an acid value of 25 mgKOH/g to 70mgKOH/g, and the polyester resin (C) has an acid value of 1 mgKOH/g to 25 mgKOH/g.

10. A developer comprising:

a toner according to claim 1, and a carrier.

11. The toner of claim 1, wherein the at least one polyester resin (A) and the polyester resin (B) comprises the alcohol component comprising 1,2-propanediol in an amount of 70 mole % or more, relative to total divalent alcohol.

12. The toner of claim 1, wherein the at least one polyester resin (A) and the polyester resin (B) comprises the alcohol component comprising 1.2-propanediol in an amount of 80 mole % or more, relative to total divalent alcohol.

13. The toner of claim 1, wherein the at least one polyester resin (A) and the polyester resin (B) comprises the alcohol component comprising 1.2-propanediol in an amount of 90 mole % or more, relative to total divalent alcohol.

14. The toner of claim 1, wherein the alcohol component of the at least one of the polyester resin (A) and polyester resin (B) comprises 60 mole % to 95 mole % the at least one divalent alcohol.

15. The toner of claim 1, wherein the alcohol component of the at least one of the polyester resin (A) and polyester resin (B) comprises 65 mole % to 90 mole % the at least one divalent alcohol.

16. The toner of claim 1, wherein the alcohol component of the at least one of the polyester resin (A) and polyester resin (B) consists essentially of the at least one aliphatic alcohol.

17. The toner of claim 1, wherein the alcohol component of the at least one of the polyester resin (A) and polyester resin (B) comprises an amount of trivalent or higher alcohol of 20 mole % or less, relative to a total amount of the alcohol component.

18. The toner of claim 1, wherein the alcohol component of the at least one of the polyester resin (A) and polyester resin (B) comprises an amount of trivalent or higher alcohol of 5 mole % to 20 mole %, relative to a total amount of the alcohol component.

19. The toner of claim 1, wherein Tm(A) is 15° C. -55° C. higher than Tm(B).

20. The toner of claim 8, wherein the softening point Tm(A) of the polyester resin (A) is 120° C. to 160° C.

* * * * *